United States Patent [19]

Barrington et al.

[11] 4,372,392

[45] Feb. 8, 1983

[54] FULL OPENING EMERGENCY RELIEF AND SAFETY VALVE

[75] Inventors: Burchus Q. Barrington, Duncan, Okla.; Wilbur P. Clayton, Aberdeen, Scotland

[73] Assignee: Halliburton Company, Duncan, Okla.

[21] Appl. No.: 194,944

[22] Filed: Oct. 7, 1980

[51] Int. Cl.[3] ..... E21B 34/12

[52] U.S. Cl. ..... 166/373; 166/330

[58] Field of Search ..... 166/124, 181, 330, 331, 166/334, 362, 363

[56] References Cited

U.S. PATENT DOCUMENTS

| | | | |
|---|---|---|---|
| Re. 27,464 | 8/1972 | Taylor, Jr. | 166/0.5 |
| 3,033,290 | 5/1962 | Brown | 166/124 X |
| 3,351,133 | 11/1967 | Clark, Jr. et al. | 166/53 |
| 3,386,701 | 6/1968 | Potts | 166/330 |
| 3,568,715 | 3/1971 | Taylor, Jr. | 137/613 |
| 3,955,623 | 5/1976 | Aumann | 166/0.6 |
| 3,967,687 | 7/1976 | Young | 137/614.11 |
| 3,990,508 | 11/1976 | Boyadjieff et al. | 166/72 |
| 4,009,753 | 3/1977 | McGill et al. | 166/55.1 |
| 4,103,744 | 8/1978 | Akkerman | 166/324 |
| 4,116,272 | 9/1978 | Barrington | 166/340 |
| 4,160,484 | 7/1979 | Watkins | 166/317 |
| 4,270,606 | 2/1981 | McStravick | 166/124 X |

OTHER PUBLICATIONS

Halliburton Drawing TC 013-0023-02, dated Dec. 31, 1978.

Halliburton Services Sales and Service Catalog No. 40, pp. 3485,3484.

Halliburton Drawing TC-013-0001-45, dated Dec. 31, 1978.

Otis Engineering Corp. Catalog OEC-5134C, at pp. 10-15.

Brochure of Flopetrol Division of Schlumberger entitled "Deep Water Operation System".

*Primary Examiner*—William F. Pate, III

*Attorney, Agent, or Firm*—Lucian Wayne Beavers; Joseph A. Walkowski; Thomas R. Weaver

[57] ABSTRACT

A full opening emergency release and safety valve includes a valve housing having a flow passage therethrough and adapted to be connected to a lower portion of a tubing string. A full opening ball valve is disposed in the valve housing for opening and closing the flow passage. A stinger assembly is adapted to be connected to an upper portion of the tubing string, and includes a stinger mandrel releasably telescopingly received within the valve housing and operably associated with the ball valve for opening and closing the ball valve in response to manipulation of the upper portion of the tubing string. A threaded connecting collar releasably interconnects the valve housing and the stinger assembly. The valve housing, ball valve, stinger assembly and threaded connecting collar are so arranged and constructed that, when disconnecting the threaded connecting collar, a first predetermined number of rotations of the stinger assembly in a right-hand direction relative to the valve housing is necessary to allow the ball valve to close the flow passage, and an additional predetermined number of rotations of the stinger assembly in the right-hand direction relative to the valve housing is necessary to release the stinger assembly from the valve housing. Several alternative embodiments of such an apparatus are disclosed along with methods of using the same.

33 Claims, 18 Drawing Figures

FULL OPENING EMERGENCY RELIEF AND SAFETY VALVE

The present invention relates generally to safety valves for closing a tubing string within a well and allowing an upper portion of the tubing string to be disconnected from a lower portion of the tubing string which remains in the well.

During offshore drilling, treating and testing operations, a drilling string or other tubing string is normally suspended from a floating vessel and extends downward within a subsea well which is being drilled, tested, or treated or the like. During emergencies, such as severe weather, it is desirable to suspend the tubing string in the well, close off the tubing string and disconnect therefrom leaving the major part of the tubing string in the well and allowing the floating vessel to leave the well site. Emergency release and safety valve apparatus for achieving these functions are often referred to as storm valves.

The prior art includes numerous types of storm valves, all of which are significantly different from the present invention.

One particular storm valve found in the prior art, and previously used by the assignee of the present invention, is the Halliburton SSC Sub-Surface Control Valve. This valve is illustrated in Halliburton Drawing TC 013-0023-02, dated Dec. 31, 1978, and its use is described at page 3485 of "Halliburton Services Sales and Service Catalog Number 40". This valve is a sliding sleeve type valve which has a stinger assembly and a valve housing which are releasably threadedly connected together by a right-handed Acme thread. As described at page 3485 of "Halliburton Services Sales and Service Catalog Number 40", the Halliburton SSC Sub-Surface Control Valve is utilized with a squeeze packer located therebelow and a slip joint located thereabove. The squeeze packer is lowered into the well and the drill string is rotated to the right thereby setting the squeeze packer. Then the drill string is rotated to the left thereby unthreading the right-handed threaded connection between the stinger assembly and the valve housing which releases the stinger assembly from the valve housing and simultaneously pulls a sleeve valve located in the valve housing upward to a closed position as the stinger mandrel moves longitudinally upward within the valve housing.

Another somewhat related valve apparatus, which is included in the prior art and has been previously used by the assignee of the present invention, is the Halliburton Ball Valve Tubing Tester illustrated in Halliburton Drawing TC 013-0001-45, dated Dec. 31, 1978, and the operation of which is described at page 3484 of "Halliburton Services Sales and Service Catalog Number 40". That device is a valve which is run with a tubing string and which includes a full opening ball valve which may be closed by placing the Ball Valve Tubing Tester in compression.

U.S. Pat. No. 3,351,133 to Clark, Jr. et al. discloses a safety valve apparatus including a full opening ball valve which is closed by setting down weight on the valve housing. This safety valve is disclosed as being utilized with a packer means located below the safety valve.

U.S. Pat. No. 3,990,508 to Boyadjieff et al. discloses a remotely operated safety valve, certain versions of which shown in FIGS. 7–22 thereof include full opening ball valves. These are wireline actuated valves which close upon the release of tension provided by a wireline leading to the surface.

U.S. Pat. No. 4,160,484 to Watkins discloses a flapper type safety valve which is actuated in response to fluid control pressure controlled at a surface location.

U.S. Pat. No. 4,103,744 to Akkerman discloses a safety valve including a full opening ball valve. This safety valve is run and retrieved by a wireline which lands the valve in an upset located within the tubing string. The valve is disclosed as being used with a packer means located below the safety valve.

The prior art also includes somewhat similar valves known as subsea test trees. A subsea test tree typically differs from a storm valve in that the subsea test tree is designed to be landed in an upset located within a blowout preventor stack and therefore is not necessarily associated with a packer means located therebelow. As mentioned, storm valves, on the other hand, are run with a packer means and may be set within the well at any location as opposed to having to be landed in a particular location as does the subsea test tree.

One such subsea test tree is disclosed in U.S. Pat. No. 4,116,272 to Barrington, and assigned to the assignee of the present invention. This subsea test tree includes full opening ball valves which are hydraulically operated. FIG. 3*a* of this reference discloses a quick release mechanism which may be operated either hydraulically or by rotation.

U.S. Pat. No. 4,009,753 to McGill et al. discloses a subsea test tree type apparatus including both a flapper valve and a full opening ball valve. The valves are hydraulic actuated. A release latch 114 may be operated either hydraulically or by rotation of the drill string.

U.S. Pat. Nos. 3,967,647 to Young and 3,955,623 to Aumann both disclose substantially the same apparatus as does McGill et al.

U.S. Pat. No. 3,568,715 to Taylor, Jr. discloses another subsea test tree including a hydraulically actuated full opening ball valve. A mechanical latching or release device is illustrated and described with reference to FIGS. 8 and 10 of this reference.

U.S. Pat. No. Re. 27,464 to Taylor, Jr. and Otis Engineering Corp. Catalog OEC-5134C, at pages 10–15, both disclose substantially the same device as shown in U.S. Pat. No. 3,568,715.

Another subsea test tree is disclosed in a brochure of the Flopetrol Division of Schlumberger at two pages thereof entitled "Deep Water Operation System" describing their "E-Z Tree".

The full opening emergency release and safety valve of the present invention includes a valve housing having a flow passage therethrough and adapted to be connected to a lower portion of a tubing string. A full opening ball valve is disposed in the valve housing for opening and closing the flow passage. A stinger assembly is adapted to be connected to an upper portion of the tubing string, and includes a stinger mandrel releasably telescopingly received within the valve housing and operably associated with the ball valve for opening and closing the ball valve in response to manipulation of the upper portion of the tubing string. A releasable threaded connecting collar releasably interconnects the valve housing and the stinger assembly. The valve housing, ball valve, stinger assembly and releasable threaded connecting collar are so arranged and constructed that, when disconnecting the releasable threaded connecting collar, a first predetermined number of rotations of the stinger assembly in a right-hand direction relative to the valve housing is necessary to allow the ball valve to close the flow passage, and an additional predetermined number of rotations of the stinger assembly in the right-hand direction relative to the valve housing is necessary to release the stinger assembly from the valve housing. Several alternative embodiments of such an apparatus are disclosed along with methods of using the same.

Numerous objects, features and advantages of the present invention will be readily apparent to those skilled in the art upon a reading of the following disclosure when taken in conjunction with the accompanying drawings.

FIG. 1 is a schematic elevation view of a floating vessel having a tubing string suspended therefrom within a subsea well.

FIGS. 2A through 2D comprise an elevational section right-side only view of a preferred embodiment of the full opening emergency release and safety valve apparatus of the present invention.

FIGS. 3A through 3D comprise a sectional elevation right-side only view of an alternative embodiment of the present invention.

FIGS. 4A through 4D comprise a sectional elevation right-side only view of a second alternative embodiment of the present invention.

FIG. 9 is an elevation right-side only section view of a locking collar such as shown in FIGS. 2C and 2D.

Figure 1:
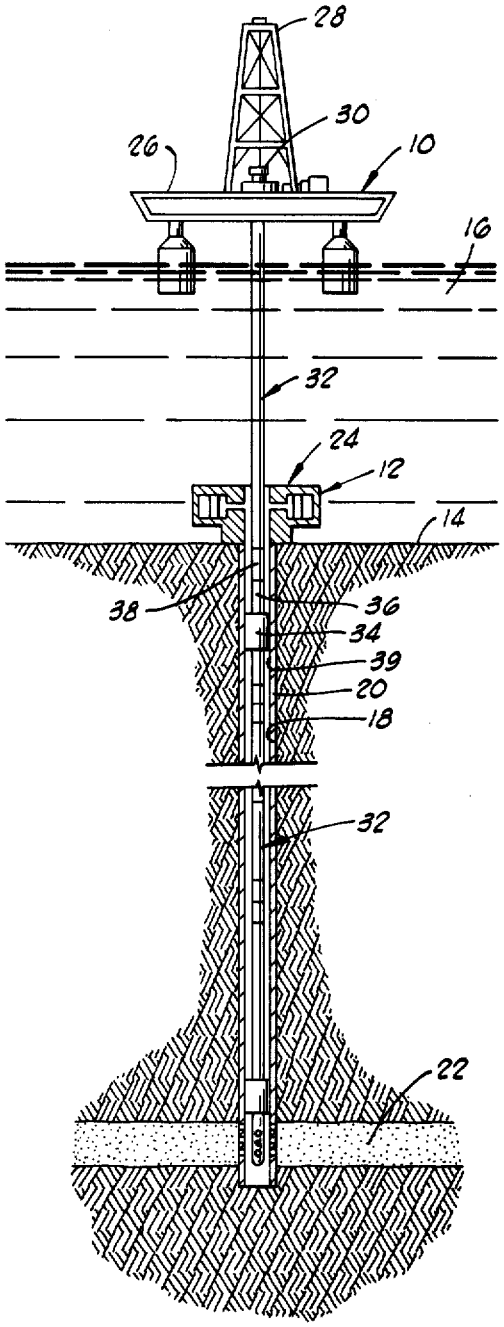

A typical arrangement for conducting a drill stem test offshore is shown in FIG. 1. Such an arrangement includes a floating work station 10 stationed over a submerged work site 12 on the floor 14 of the ocean 16. The well comprises a well bore 18 typically lined with a casing string 20 extending from the work site 12 to a subsurface formation 22. The casing string 20 includes a plurality of perforations at its lower end which provide communication between the formation 22 and the interior of casing 20.

At the well site 12 is located a well head installation 24 which includes blowout preventor mechanisms.

The floating work station 10 includes a work deck 26 which supports a derrick 28. The derrick 28 supports a hoisting means 30.

Suspended from the hoisting means 30 and extending down into the well casing 20 is a tubular testing string 32.

Similarly, the tubular string 32 could be used for treating the well or could be a tubular drill string with a drill bit at the end thereof which is used in initially drilling the well or performing some type of workover on the well.

The length of the portion of the tubular string 32 located above the well head 24 will typically be on the order of several hundred feet and the length of the remaining portion of the tubular string 32 extending downward into the well casing 20 may be many thousands of feet.

In many offshore drilling areas, such as the North Sea for example, environmental conditions often become so severe that there is excessive movement of the floating work station 10 relative to the well head 24 and operations must be discontinued for safety reasons. These severe environmental conditions often develop very rapidly requiring that a means be available for quickly disconnecting from the portion of the tubing string located within casing 20 and for closing off that portion of the tubing string. Additionally, due to the great expense of operating an offshore drilling rig it is desirable that down time be kept to a minimum and this also makes it necessary that a means be provided for rapidly disconnecting the tubing string 32.

The present invention provides a full opening emergency release and safety valve which may be attached to the tubing string 32 as the severe weather approaches and which then may be lowered into the well casing 20 at a point relatively near the upper end thereof, i.e., near the well head 24, and which can accomplish this purpose of closing off a portion of tubular string 32 remaining in the casing 20 and disconnecting the remainder of tubular string 32 therefrom.

To this end, a packer means 34, emergency release and safety valve apparatus 36, and a slip joint 38 are attached, preferably in that order, to the tubular string 32 and lowered into the well casing 20 as schematically illustrated in FIG. 1.

The packer means 34 is preferably a Halliburton RTTS Retrievable Packer such as is illustrated and described at page 3476 of "Halliburton Services Sales and Service Catalog Number 40". Upon rotation of tubular string 32 clockwise as viewed from above, the packer means 34 is expanded to seal an annulus 39 between tubular string 32 and well casing 20.

The slip joint 38 is a telescoping extension joint which compensates for up and down movement of floating work station 10 relative to well head 24 and thereby allows a constant weight to be set down on tools below the slip joint 38.

Embodiment of FIGS. 2A–2D

Referring now to FIGS. 2A through 2D, a preferred embodiment of the emergency release and safety valve apparatus 36 is thereshown.

The valve apparatus 36 includes a valve housing, generally designated by the numeral 40, which has a flow passage 42 therethrough and which includes a lower adapter 44 for connecting the valve housing 40 to a lower portion of tubing string 32 located below the valve apparatus 36.

A full opening ball type flow valve means 46 is disposed in valve housing 40 for opening and closing flow passage 42.

A stinger assembly, generally designated by the numeral 48, includes an upper adapter 50 for connecting stinger assembly 48 to an upper portion of the tubing string 32 located above valve apparatus 36.

Stinger assembly 48 includes a stinger mandrel 52 which is releasably telescopingly received within valve housing 40 and which is operably associated with ball valve 46 through an actuating mandrel assembly, generally designated by the numeral 54, for opening and closing the ball valve 46 in response to manipulation of the upper portion of tubing string 32.

A connecting collar 56, which may generally be referred to as a releasable threaded connecting means, provides a means for releasably interconnecting the valve housing 40 and the stinger assembly 48.

As is further described below in detail, the valve housing 40, ball valve means 46, stinger assembly 48, and releasable threaded connecting means 56 are so arranged and constructed that, when disconnecting the releasable threaded connecting means 56, a first predetermined number of rotations of stinger assembly 48 in a clockwise direction as viewed from above relative to valve housing 40 is necessary to allow the ball valve means 46 to close the flow passage 42, and an additional predetermined number of clockwise rotations of stinger assembly 48 relative to valve housing 40 is necessary to release the stinger assembly 48 from the valve housing 40.

The specific construction of the various components just generally described will now be described in detail.

The stinger mandrel 52 is connected to upper adapter 50 at threaded connection 58. Rotation between stinger mandrel 52 and upper adapter 50 is prevented by a plurality of set screws such as set screw 59.

Extending downward from upper adapter 50 is an annular skirt 60 having an annular load transfer surface 62 defined on the lower end thereof. Skirt 60 is disposed concentrically around and radially outward from stinger mandrel 52 thereby defining an annular cavity 64 between skirt 60 and stinger mandrel 52.

When stinger mandrel 48 is fully inserted within valve housing 40 as shown in FIGS. 2A-2D, the load transfer surface 62 is engaged with an annular support surface 66 defined on the upper end of valve housing 40.

Valve housing 40 includes an upper tubular housing portion 68, a middle adapter 70 connected to upper portion 68 at threaded connection 72, and a lower tubular housing portion 74 connected to middle adapter 70 at threaded connection 76. The lower adapter 44 is connected to lower tubular housing portion 74 at threaded connection 78.

Stinger mandrel 52 includes a plurality of longitudinal outer splines 80. Splines 80 terminate at upper ends 82 and lower ends 84.

Disposed in annular cavity 64 between an upper end thereof and the upper end 82 of splines 80 is a resilient compression spring governing means 86 for governing a longitudinal force exerted on connecting collar 56 when the stinger assembly 48 is being reconnected to the valve housing 40 as is further described below. Governing spring 86 is preferably formed of a plurality of Belleville springs as shown.

Connecting collar 56 is a cylindrical collar disposed between stinger mandrel 52 and valve housing 40. Connecting collar 56 includes a plurality of radially inner longitudinal splines 88 meshing with splines 80 of stinger mandrel 52. Connecting collar 56 has a radially outer left hand threaded surface 90 which is threadedly connected to an inner left hand threaded surface 92 of valve housing 40.

Valve housing 40 includes a radially inward projecting torquing lug 94 located just below threaded surface 92. An upper end 96 of lug 94 engages connecting collar 56 when it is in the position shown in FIG. 2A, thereby defining the downwardmost position of connecting collar 56. This may also be referred to as the position where connecting collar 56 is fully made up with threaded surface 92 of valve housing 40.

Figure 2A:
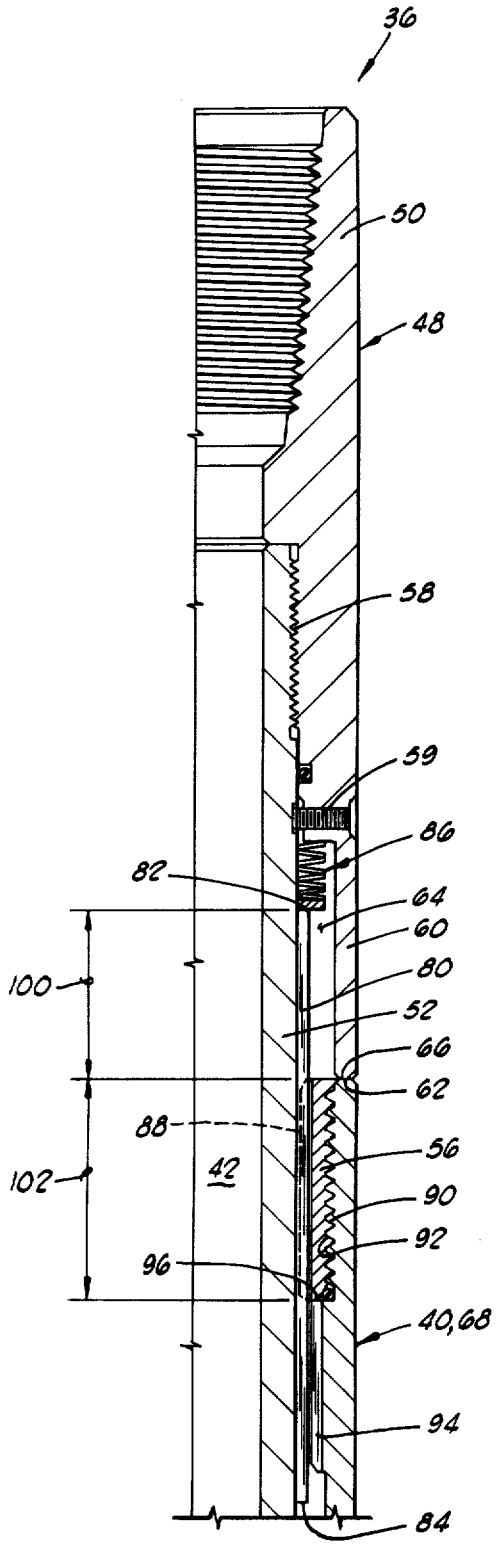
Figure 2B:
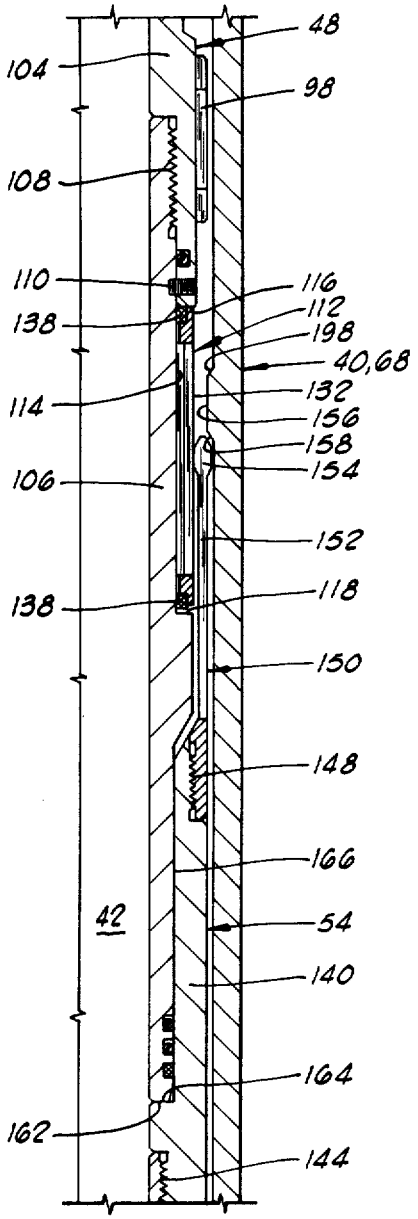

Stinger mandrel 52 includes a radially outward extending torquing lug 98 located below splines 80 as seen in FIG. 2B. Torquing lug 98 defines a lowermost position of connecting collar 56 relative to stinger mandrel 52 and prevents connecting collar 56 from sliding downward off of the splines 80. Thus torquing lug 98 may be described as a retaining means for limiting downward movement of connecting collar 56.

Thus, the stinger assembly 48 is telescopable within the valve housing 40 between a lowermost position wherein load transfer surface 62 engages support surface 66, and an upwardmost position where torquing lug 98 engages connecting collar 56.

Thus, so long as connecting collar 56 is threadedly engaged with threaded surface 92 of valve housing 40, the stinger assembly 48 is still connected to valve housing 40 and cannot be totally removed therefrom. However, once the connecting collar 56 is disconnected from threaded surface 92 it is possible to completely withdraw stinger assembly 48 from valve housing 40.

The stinger assembly 48 is disconnected from valve housing 40 by rotating stinger assembly 48 clockwise as viewed from above relative to valve housing 40 thereby backing off the threaded connection between threads 90 and 92. This causes the connecting collar 56 to move upward into annular cavity 64.

As may be seen in FIG. 2A, a longitudinal distance 100 between governing spring 86 and the uppermost thread of threaded surface 92 of valve housing 40 is less than a length 102 of connecting collar 56, so that when connecting collar 56 is disposed in cavity 64 and is being reconnected with the threaded surface 92, the governing spring 86 is in compression and initially urges the connecting collar 56 downward so that the threads 90 thereof will initially make up with the threads 92 of valve housing 40. Also, it is seen that since most of the weight of the tubular string 32 is carried by the engagement of load transfer surface 62 with supporting surface 66, the longitudinal load applied to connecting collar 56 to cause it to threadedly engage with threaded surface 92 is governed by the resilient force of compression spring 86.

Stinger mandrel 52 is comprised of an upper stinger mandrel portion 104 and a lower stinger mandrel portion 106 threadedly connected together at 108. A plurality of set screws such as set screw 110 prevent rotation between stinger mandrel portions 104 and 106.

Stinger mandrel 52 includes a radially resilient spring collar 112 disposed about an outer surface 114 of lower stinger mandrel portion 106 and located between a lower end 116 of upper stinger mandrel portion 104 and an upward facing shoulder 118 of lower stinger mandrel portion 106.

Figure 6:
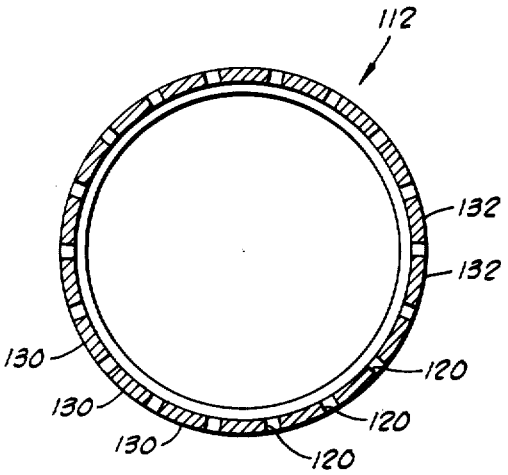
FIG. 6 is a section view along line 6—6 of FIG. 5.
Figure 5:
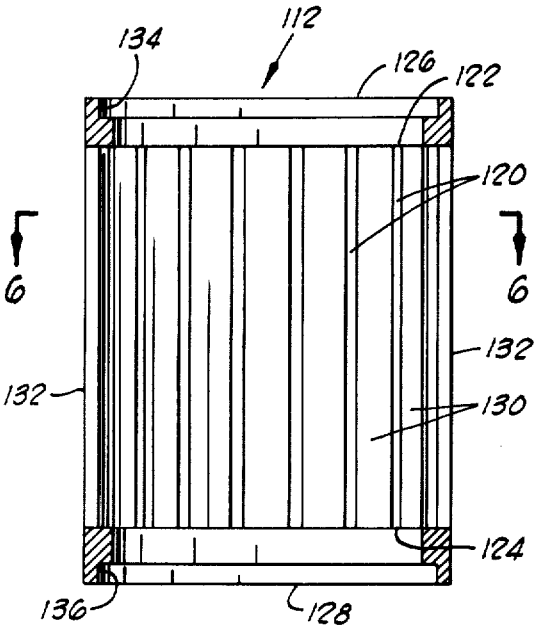
FIG. 5 is an elevation section view of the spring collar disposed about the stinger mandrel of 2B.
Figure 8:
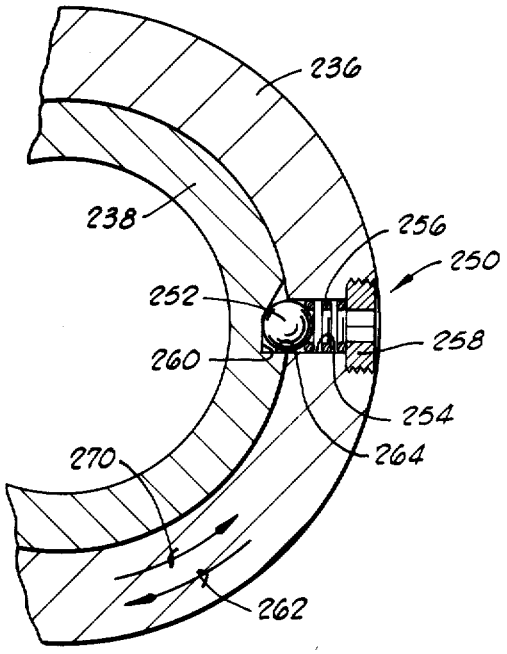

Spring collar 112 is best shown in FIGS. 5 and 6.

Spring collar 112 is a cylindrical sleeve having a plurality of angularly spaced longitudinal slots 120 therethrough. Each of the slots 120 terminate at upper and lower ends 122 and 124 short of upper and lower ends 126 and 128, respectively, of the cylindrical sleeve thereby forming a plurality of longitudinally oriented parallel spring bars 130.

The outer surfaces 132 of the spring bars 130 define a radially outer latch holding surface 132 of stinger mandrel 52 for resiliently engaging a latch means as further described below.

The upper and lower ends of spring collar 112 include annular notches 134 and 136 disposed therein for receiving bushing rings 138 as seen in FIG. 2B.

The actuating mandrel assembly 54 includes an upper portion 140 and a lower portion 142 threadedly connected together at 144. The lower portion 142 is connected to ball valve means 48 at threaded connection 146.

Figure 2C:
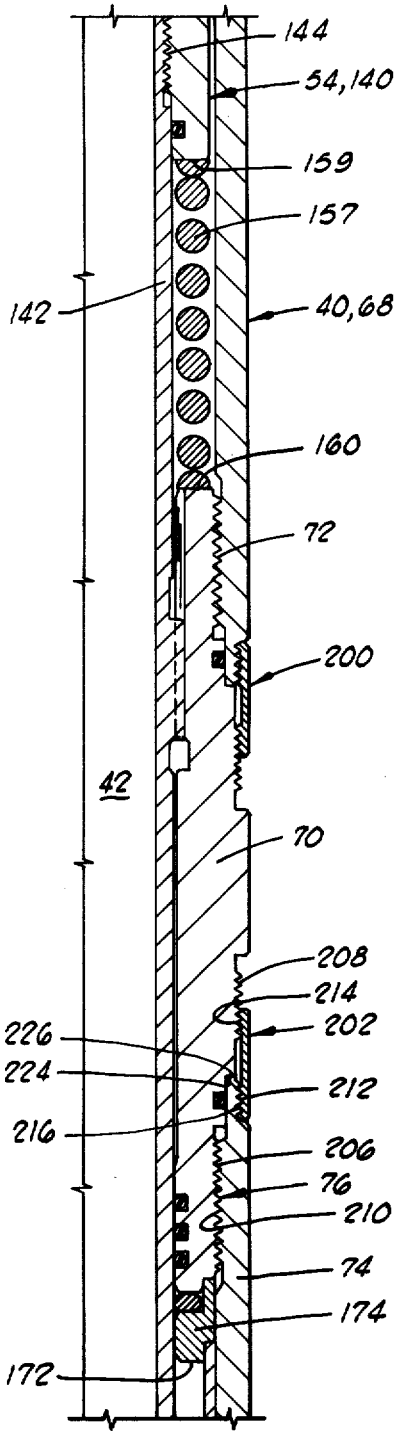
Figure 2D:
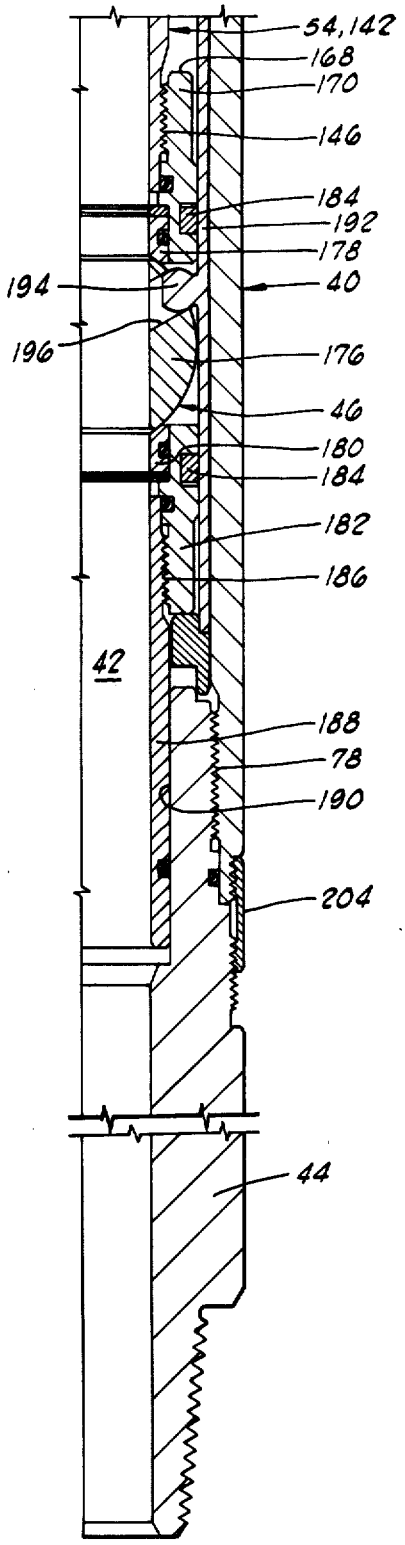

Actuating mandrel assembly 54 is illustrated in FIGS. 2B–2D in its lowermost first position relative to valve housing 40, with the ball valve means 46 in its open position as shown in FIG. 2D.

As is further described below, actuating mandrel assembly 54 is longitudinally movable within valve housing 40 to an uppermost second position corresponding to a closed position of ball valve means 46.

Threadedly connected at 148 to upper portion 140 of actuating mandrel assembly 54 is a latching collet means 150 for latching actuating mandrel assembly 54 in its said first position as shown in FIG. 2B.

Latching collet means 150 includes a plurality of collet fingers 152 extending upward from upper actuating mandrel portion 140 about stinger mandrel 52. Each of said collet fingers 152 has a head 154 on an upper end thereof.

Valve housing 40 includes a radially inward extending ledge 156 having a downward facing tapered surface 158 thereon for engaging heads 154 and preventing upward movement thereof.

As can be seen in FIG. 2C a coil compression spring 157 is located between a downward facing surface 159 of upper actuating mandrel portion 140 and an upward facing surface 160 of middle adapter 70. The coil compression spring 157 biases the actuating mandrel assembly 54 upward relative to valve housing 40 towards the second position of actuating mandrel assembly 54 corresponding to the closed position of ball valve means 46.

When the stinger assembly 48 is fully inserted in valve housing 40 as shown in FIGS. 2A–2D, a lower end 162 of stinger assembly 48 engages an upward facing surface 164 of upper actuating mandrel portion 140. The heads 154 of collet fingers 152 are located below ledge 156 and are prevented from moving inward by latch holding surface 132 of spring collar 112, thereby latching actuating mandrel assembly 54 in its said first position corresponding to the open position of ball valve means 46.

Lower stinger mandrel portion 106 includes a reduced diameter outer surface 166 located below spring collar 112 so that when stinger assembly 48 is moved longitudinally upward relative to valve housing 40, through a sufficient distance so that the heads 154 of collet fingers 152 are adjacent reduced diameter outer surface 166, the upward biasing force from coil compression spring 157 will cause heads 154 to be cammed inward past downward facing surface 158 and past ledge 156 through a distance such that an upper end 168 of an upper valve seat holder 170 of ball valve means 46 engages a downward facing surface 172 of spacer ring 174 attached to valve housing 40 as seen in FIG. 2C. This defines the second position of actuating mandrel assembly 54 corresponding to the closed position of ball valve means 46.

The ball valve means 46 includes a spherical valve member 176 rotatingly supported between upper and lower valve seats 178 and 180, respectively. The valve seats 178 and 180 are held in upper valve seat holder 170 and a lower valve seat holder 182, respectively.

The upper and lower valve seat holders 170 and 182 are held together by C-shaped springs, ends of which are shown in cross-section and designated by the numeral 184. Lower valve seat holder 182 is threadedly connected at 186 to a lower guide mandrel 188 which is closely slidingly received within an inner bore 190 of lower adapter 44.

Fixedly connected to valve housing 40 is a ball valve actuating piece 192 which has an inward extending lug 194 which is received within an eccentric radial bore 196 of ball valve member 176, so that the ball valve member 176 is rotated from its open position shown in FIG. 2D to a closed position closing flow passage 42 when actuating mandrel assembly 54 is moved longitudinally upward relative to valve housing 40.

Operation

The general manner of operation of valve apparatus 36 is as follows. When the valve apparatus 36 is attached to the tubing string 32 and lowered into the well casing 20, the connecting collar 56 is fully made up with threaded surface 92 as seen in FIG. 2A and the actuating mandrel assembly 54 is latched in its first position as seen in FIGS. 2B–2D with the ball valve means 46 in its open position.

The relative dimensions of the various components are such that so long as the connecting collar 56 is fully made up with threaded surface 92, the upward telescoping motion of stinger mandrel 52 within valve housing 40, as limited by engagement of torquing lug 98 with the lower end of connecting collar 56, is such that the heads 154 of collet fingers 152 are retained latched against the downward facing surface 158 of ledge 156 thereby retaining the actuating mandrel assembly 54 in its first position regardless of the position of the stinger mandrel 52 within the valve housing 40.

As the valve apparatus 36 is lowered into the well casing 20, before the packer means 34 is set against the well casing 20, the valve apparatus 36 is in tension so that the stinger assembly 48 is moved upward relative to valve housing 40 from the position shown in FIGS. 2A–2B to a position where torquing lug 98 engages the lower end of actuating collar 56.

When the valve apparatus 36 is in tension and the torquing lug 98 engages the lower end of connecting collar 56, the torquing lug 98 extends radially outward past an innermost part of torquing lug 94 of valve housing 40. This prevents relative rotational movement between stinger assembly 48 and valve housing 40 so long as the valve apparatus 36 is in tension.

Thus, when the valve apparatus 36 and packer 34 are lowered to the desired position in well casing 20 at which it is desired to set packer means 34 to seal the annulus 39 between the tubing string 32 and casing 20, the tubing string 32 may be rotated and thus rotate the stinger assembly 48 and the valve housing 40 transmitting this rotational motion down to the packer means 34 which is set by said rotational motion.

The packer means 34 is of a conventional design as previously mentioned so that it is set by clockwise rotation as viewed from above.

After the packer means 34 is set, then the weight of the tubing string located below packer means 34 and connected thereto is supported from the well casing 20 by the packer means 34.

Then the upper portion of the tubing string 32 is set down. This places the valve apparatus 36 in compression and the load transfer surface 62 of stinger assembly 48 engages the annular support surface 66 of housing 40.

This places the valve apparatus 36 in the position illustrated in FIGS. 2A–2D. In this position, the torquing lug 98 of stinger assembly 48 is located below and out of engagement with the torquing lug 94 of valve housing 40, thus permitting relative rotational movement between stinger assembly 48 and valve housing 40.

Then upon right hand rotation as viewed from above of the stinger assembly 48 relative to valve housing 40, the connecting collar 56 begins to back off of the threaded surface 92 because the connecting collar 56 is left-hand threaded.

The dimensions of the described apparatus are such that after the stinger assembly 48 has been rotated approximately 3 or 4 turns clockwise as viewed from above relative to the valve housing 40, the connecting collar 56 is moved upward by a sufficient distance so that the uppermost position of stinger mandrel 52 defined by the engagement of torquing lug 98 with the lower end of connecting collar 56 is moved sufficiently upward so that the reduced diameter surface 166 of lower stinger mandrel portion 106 is adjacent heads 154 of collet fingers 152. Then the heads 154 may move radially inward and then upward past the ledge 156 thereby allowing coil compression spring 157 to push actuating mandrel assembly 154 upward to its second position corresponding to the closed position of ball valve means 46.

It is noted that it is not necessary to fully unthread the connecting collar 56 from threaded surface 92 in order to allow the ball valve means 46 to close. However, the ball valve means 46 does not close until the stinger assembly 48 is moved longitudinally upward relative to valve housing 40 by lifting tubular string 32.

Further clockwise rotation as viewed from above of stinger assembly 48 relative to valve housing 40 completely disengages the threads 90 of connecting collar 56 from the threaded surface 92 of valve housing 40. At that point the stinger assembly 48 is disconnected from the valve housing 40 and may be lifted upward completely out of engagement therewith.

After the severe weather is past, it is then desirable to reconnect the upper portion of tubing string 32 having the stinger assembly 48 attached thereto to the lower portion of tubing string 32 connected to valve housing 40 and suspended in the well casing 20. This is done by lowering the tubing string 32 until the stinger assembly 48 engages valve housing 40 and inserting the stinger mandrel 52 into the valve housing 40.

Remembering that the actuating mandrel 54 is in its second uppermost position relative to valve housing 40 when this reconnection operation begins, the lower end 162 of stinger mandrel 52 engages the upward facing surface 164 of actuating mandrel assembly 54 and then the actuating mandrel assembly 54 is pushed downward with further downward movement of stinger mandrel 152. When the heads 154 of collet fingers 152 engage an upward facing surface 198 of ledge 156 the inward camming action on the heads 154 causes them to push the spring bars 130 of spring collar 112 radially inward sufficient for the heads 154 to move downward past ledge 156 to the lowermost first position of actuating mandrel 154 where the outward biasing action of spring bars 130 then pushes the heads 154 outward and they are again located at the position shown in FIG. 2B.

This downward inserting motion of stinger assembly 48 into valve housing 40 is limited by engagement of the load transfer surface 62 with the supporting surface 66 as seen in FIG. 2A.

Once this longitudinal insertion is completed the connecting collar 56 will be trapped in annular cavity 64 and will have the governing spring 86 compressed. Thus, the governing spring 86 will be urging the connecting collar 56 downward so that its threads 90 are urged into engagement with the threads 92 of valve housing 40.

Then the tubular string 32 suspended from the floating work deck 10 is rotated counterclockwise as viewed from above so as to make up the threads 90 of connecting collar 56 with the threads 92 of valve housing 40 until the connecting collar 56 is moved once again into the fully made up position of FIG. 2A.

Locking Collar of FIG. 9

It will be appreciated by those skilled in the art that the joints of a typical downhole tool are generally made up with right-hand threads. Thus, it is important that provision be made to prevent these right-hand threads from unscrewing when the tubular string 32 is rotated counterclockwise or in a left-hand direction as viewed from above.

This is accomplished for certain of the threaded joints in the valve apparatus 36 by the use of locking collars such as locking collars 200, 202 and 204, as seen in FIGS. 2C and 2D.

For purposes of illustration, the locking collar 202 will be described in detail. Locking collars 200 and 204 are similarly constructed.

The middle adapter 70 has an outer right hand threaded surface 206 which forms a part of threaded connection 76 previously mentioned. Middle adapter 70 also includes a second outer threaded surface 208 which is left-hand threaded.

Lower tubular valve housing portion 74 includes an inner right-handed threaded surface 210 which is made up with the threaded surface 206 of middle adapter 70. Lower tubular valve housing portion 74 also includes an outer left-handed threaded surface 212.

The locking collar 202 has internal left-handed threads comprising an upper left-handed portion 214 engaged with left-handed threads 208 of middle adapter 70 and a lower left-hand threaded portion 216 engaged with left-hand threads 212 of lower tubular valve housing portion 74.

When left-hand torque is transmitted from middle adapter 70 to lower tubular valve housing portion 74, the locking collar 202 prevents rotation of middle adapter 70 relative to lower tubular valve housing portion 74. This is accomplished because of the fact that such left-hand rotation of middle adapter 70 relative to lower tubular valve housing portion 74 would cause the left-hand threads 208 and 212 to further make up with the threads 214 and 216 of locking collar 202 thereby stretching the locking collar 202 or placing it in tension.

The details of construction of the locking collar 202 are best shown in FIG. 9 which is a sectional right side only elevational view thereof. The threads 214 and 216 are preferably Acme threads. They are separated by a non-threaded inner cylindrical surface 228.

The assembly is initially made by engaging threads 214 with threads 208 and running the locking collar 202 all the way up on middle adapter 70. Then the threaded connection 76 is made up. Then the locking collar 202 may be rotated in a left-hand fashion running it down thread 208 and causing it to make up with thread 212.

The threads 214 and 216 are cut on the same lead, i.e., an extension of one of the threads 214 or 216 would coincide with the other. The threads 208 and 212 of middle adapter 70 and lower tubular valve housing portion 74 are cut so that, when a downward facing shoulder 224 of middle adapter 70 abuts upward facing shoulder 226 of lower tubular valve housing portion 74, an extension of one of the threads 208 or 212 would coincide with the other.

Alternative Embodiment of FIGS. 3A-3D

Referring now to FIGS. 3A-3D, an alternative embodiment of the valve apparatus 36 is there generally designated by the numeral 36A. Components in FIGS. 3A-3D substantially similar to those of FIGS. 2A-2D are designated by the same numerals used in FIGS. 2A-2B. Components of the apparatus 36A which have been modified are indicated by the same numerals as used in FIGS. 2A-2D with the addition of a suffix "A".

Valve apparatus 36A is modified in that the means for latching the actuating mandrel assembly 54 in its first position corresponding to the open position of ball valve means 46 has been modified.

Figure 3A:
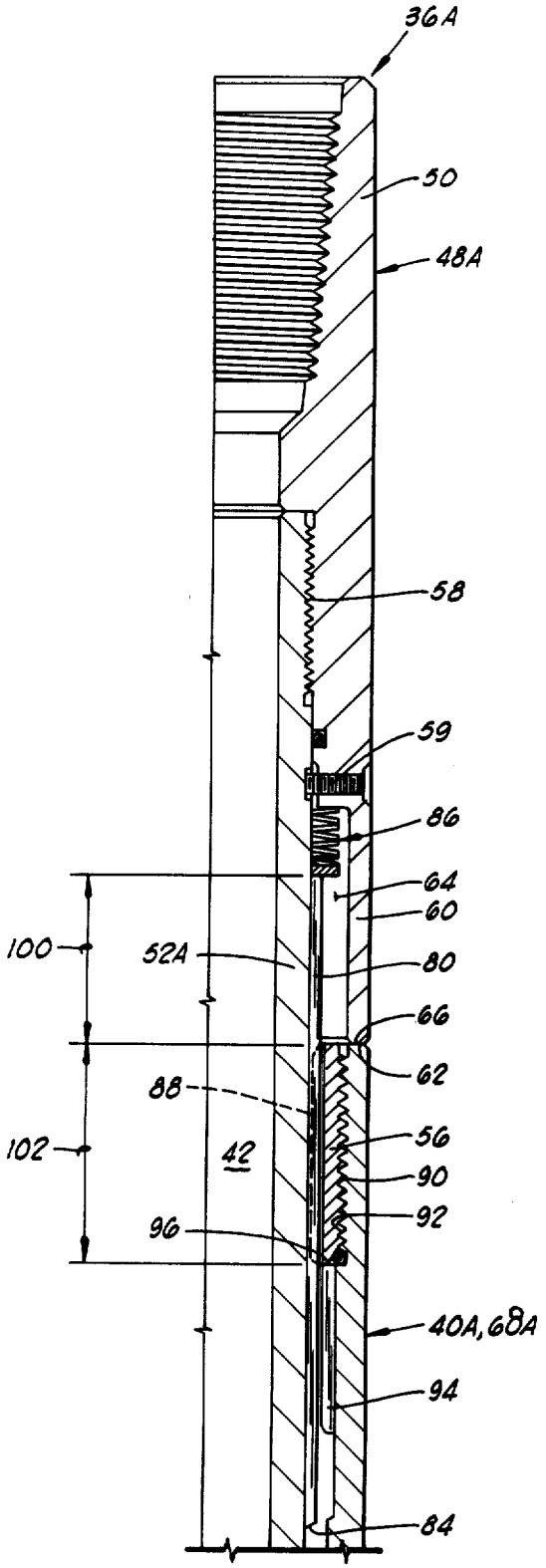
Figure 3B:
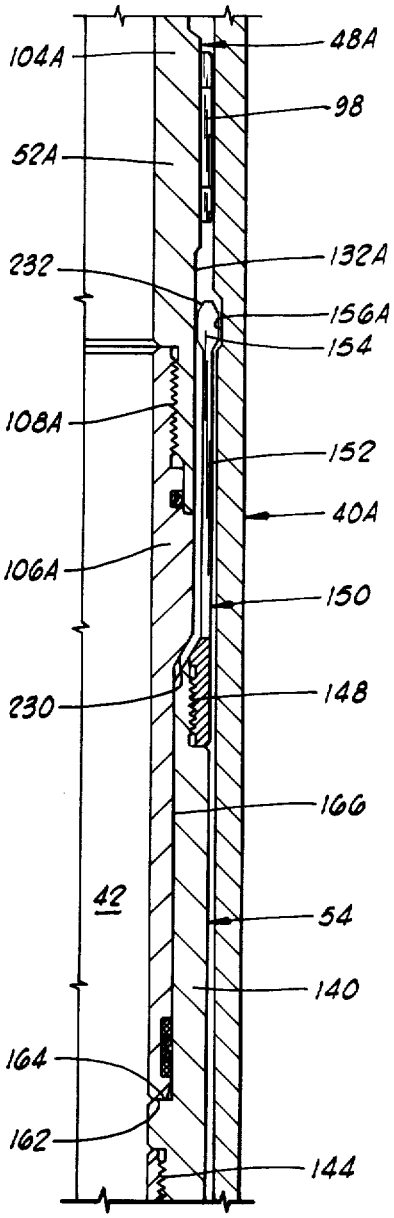
Figure 3C:
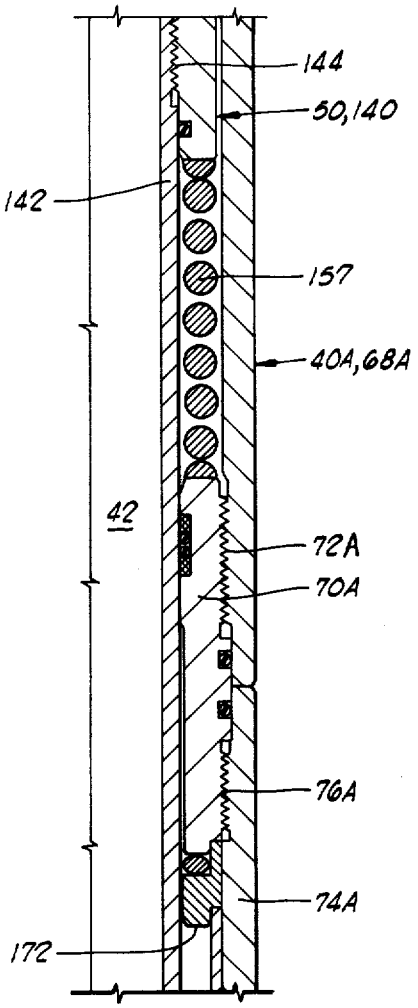
Figure 3D:
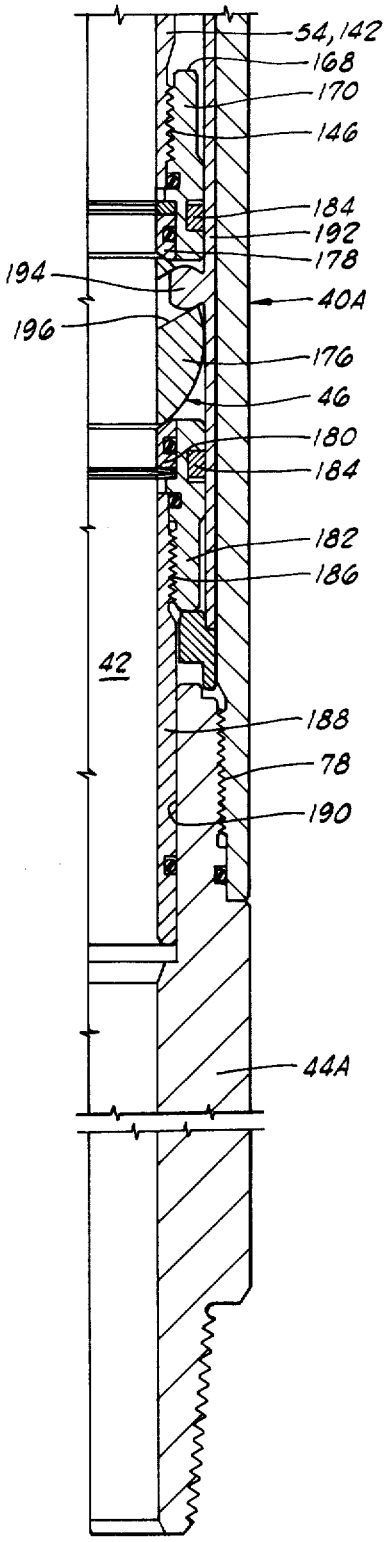

A stinger mandrel 52A as shown in FIG. 3B does not have a spring collar like the spring collar 112 of FIG. 2B. Instead, stinger mandrel 52A includes a solid non-resilient outer latch holding surface 132A which engages the heads 154 of collet fingers 152.

A modified valve housing 40A does not includes the inner ledge 156 as shown in FIG. 2B, but rather has an annular inner recess 156A within which the heads 154 are received.

Thus, the actuating mandrel assembly 54 is latched in its first position relative to valve housing 40A, corresponding to the open position of ball valve means 46, when the heads 154 are held in annular recess 156A by outer latch holding surface 132A of stinger mandrel 152A.

The heads 154 are released in a manner similar to that of valve apparatus 36, when a reduced diameter portion 166 of stinger mandrel 52A is moved upward to a position adjacent heads 154 allowing them to move radially inward out of engagement with the annular groove 154A.

Another change, as compared to the valve apparatus 36, is seen when the stinger assembly 48A is reinserted in the valve housing 40A to reconnect the upper and lower portions of tubing string 32.

When stinger mandrel 52A is initially reinserted into valve housing 40A, the lower end 162 thereof does not initially engage the upward facing surface 164 of actuating mandrel 54. Rather, a downward facing tapered transition surface 230 connecting surface 132A and reduced diameter surface 166 first engages an upward facing radially inner tapered surface 232 of each of the valve heads 154.

This engagement between surfaces 230 and 232 is maintained until the actuating mandrel 54 has been pushed longitudinally downward within valve housing 40A to the position shown in FIG. 3B, where the heads 154 then move radially outward into engagement with the annular head receiving groove 156A. The latch retaining surface 132 then moves into engagement with the radially innermost surface of heads 154 and the stinger mandrel 52A then moves longitudinally downward relative to actuating mandrel 54 until the lower end 162 of stinger mandrel 52A engages the upward facing annular surface 164 of actuating mandrel 54.

Alternative Embodiment of FIGS. 4A-4D

Referring now to FIGS. 4A-4D, a second alternative embodiment of the emergency release and safety valve of the present invention is shown and generally designated by the numeral 36B.

The primary modification to the apparatus 36B is that it is so constructed that when the stinger assembly 48B is rotated a first predetermined number of clockwise rotations relative to valve housing 40B, the actuating mandrel assembly 54B is caused to move longitudinally relative to valve housing 40B thereby closing ball valve means 46. A major difference in the functioning of valve 36B as compared to valve apparatus 36 is that with valve apparatus 36 the rotation through the first predetermined number of rotations did not actually cause the ball valve means 46 thereby to be closed but merely allowed it to be closed upon subsequent longitudinal movement of the stinger assembly 48 relative to the valve housing 40.

With the valve apparatus 36B the actuating mandrel assembly 54B is threadedly connected to the valve housing 40B at a left-hand threaded connection 234 so that clockwise rotation of actuating mandrel assembly 54B relative to valve housing 40B causes the threaded connection 234 to be backed off, thereby moving a lower portion of the actuating mandrel assembly 54B longitudinally upward relative to valve housing 40B thereby closing the ball valve means 46 without the need for any longitudinal upward movement of stinger assembly 48B relative to valve housing 40B. The details of this structure are as follows.

The stinger mandrel 52B is modified, as compared to the stinger mandrel 52 of FIGS. 2A-2B, in that it does not include a structure similar to the outer latch holding surface 132 of the valve apparatus 36, but rather, directly below the torquing lug 98 is located the reduced diameter outer surface 166B.

The actuating mandrel assembly 54B includes an upper actuating mandrel 236 and a lower actuating mandrel 238.

A lowest portion 239 of lower actuating mandrel 238 is rotatingly connected to an upper portion 241 of lower actuating mandrel 238 by a shoulder 243 held between bushings 245 and 247. A pin 251 connects upper portion 241 of lower actuating mandrel 238 to a collar 253 which makes up with valve housing 40B at threaded connection 234.

Upper actuating mandrel 236 has a plurality of upwardly open longitudinal grooves 240 therein, within which are received a plurality of lugs such as torquing lugs 98. This permits the upper actuating mandrel 236 to be rotated with stinger mandrel 52B when the stinger assembly 48B is set down upon the valve housing 40B and torquing lug 98 is received within the groove 240.

An upper end 242 of upper actuating mandrel 236 engages the lower end of torquing lug 94 of valve housing 40B.

A coil compression spring 244 is located between a lower end 246 of upper actuating mandrel 236 and an upward facing surface 248 of lower actuating mandrel 238. This provides a downward biasing force on lower actuating mandrel 238, the purpose of which is further described below.

Figure 4A:
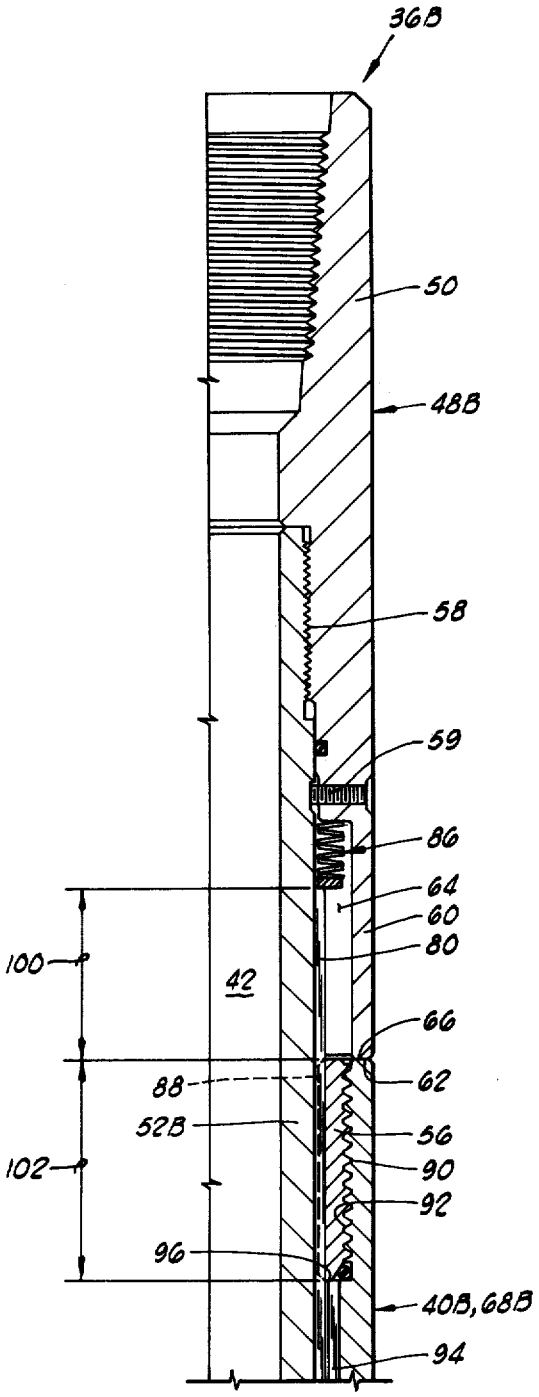

The actuating mandrel assembly 54B includes a motion transfer means 249, which is comprised of the threaded connection 234 between lower actuating mandrel 238 and valve housing 40B, and an interlocking means, generally designated by the numeral 250, between upper and lower actuating mandrel 236 and 238. This motion transfer means 249 is a means for translating rotational motion, of the stinger assembly 48B through said first predetermined number of rotations relative to the valve housing 40B, into longitudinal motion relative to valve housing 40B of the lower actuating mandrel 238 connected to ball valve means 46. This longitudinal motion of lower actuating mandrel 238 is from a first position as illustrated in FIGS. 4B–4D, and corresponding to the open position of ball valve means 46 as shown in FIG. 4D, to an upper second position relative to valve housing 40B with threaded connection 234 disconnected and corresponding to a closed position of ball valve means 46.

Thus, the entire actuating mandrel assembly 54B may be said to have a first and a second position corresponding to the open and closed positions of ball valve means 46, but it is understood that it is the lower actuating mandrel 238 of actuating mandrel 54B which actually moves longitudinally and that the upper actuating mandrel 236 does not move longitudinally when the actuating mandrel assembly 54B moves from its first to its second position.

Figure 8:
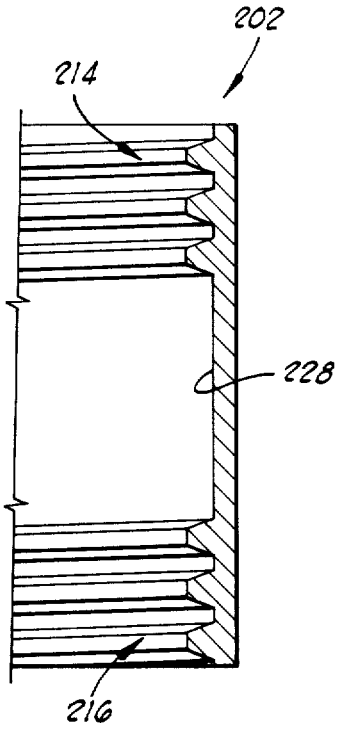
FIG. 8 is a partial section view along line 8—8 of FIG. 4B again illustrating the interlocking means of FIG. 7.
Figure 7:
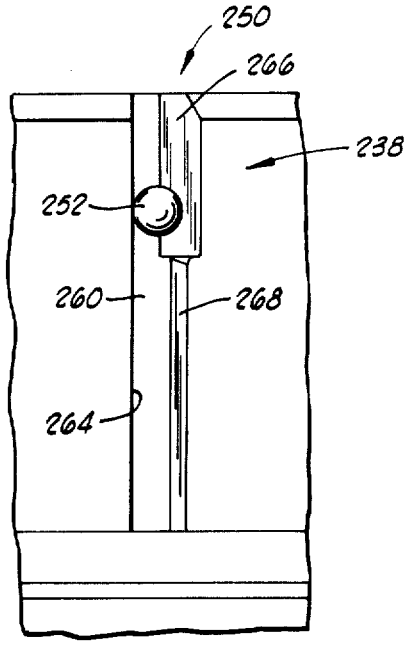
FIG. 7 is a partial elevation view taken along line 7—7 of FIG. 4B illustrating the interlocking means between the upper and lower actuating mandrels of FIG. 4B.

The interlocking means 250, best seen in FIGS. 7 and 8, includes a spring loaded spherical ball element 252 partially received within a radial bore 254 through upper actuating mandrel 236. A coil compression spring 256 is retained in bore 254 by a threaded insert 258. An upper end of lower actuating mandrel 238 has a groove 260 disposed therein within which the spherical ball member 252 is received.

Figure 4B:
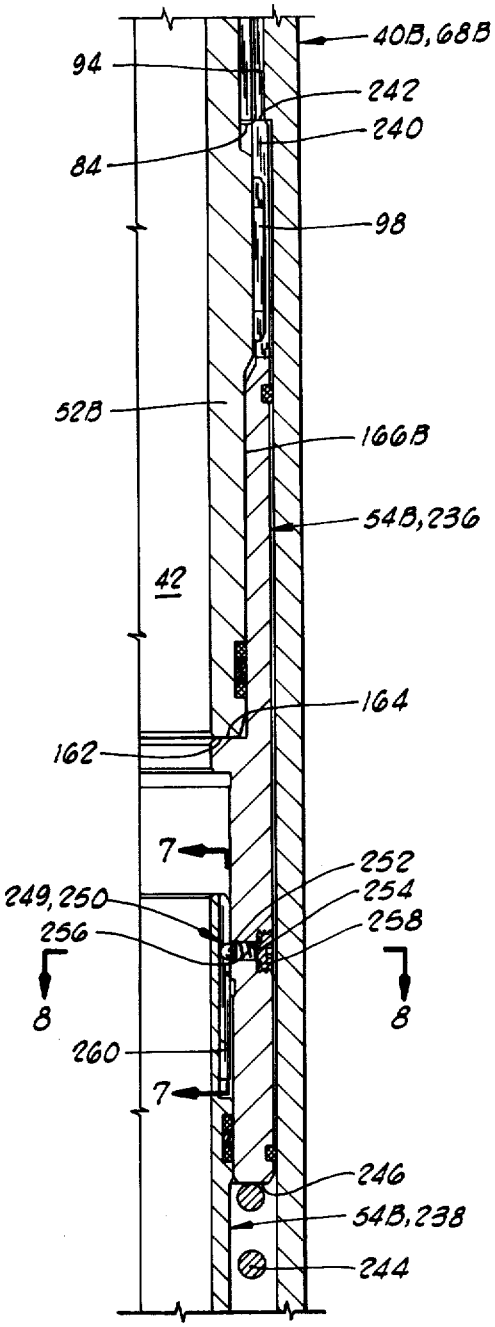
Figure 4C:
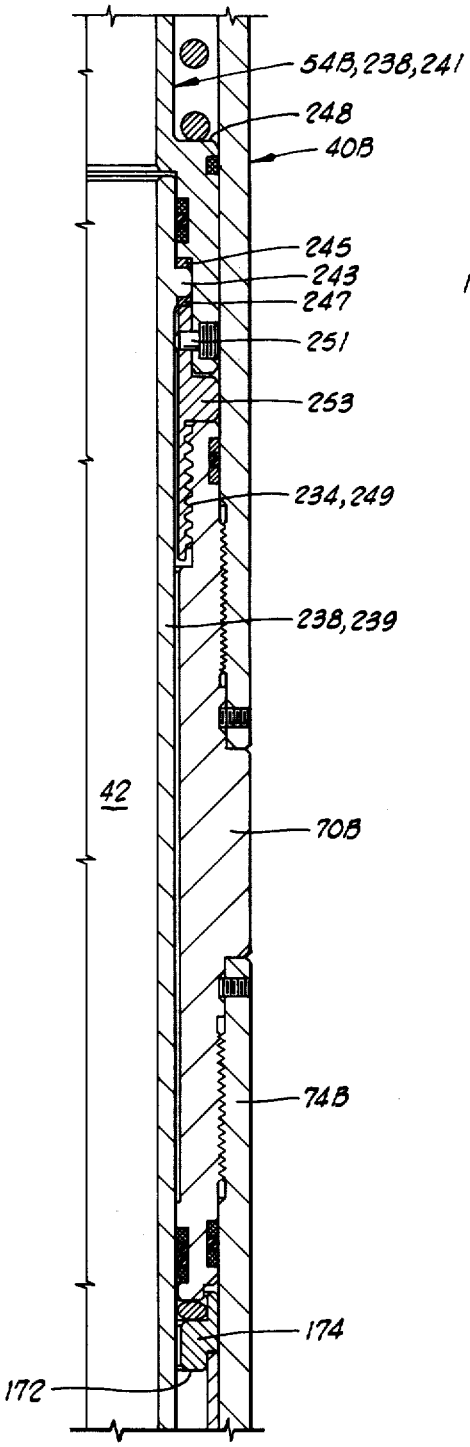
Figure 4D:
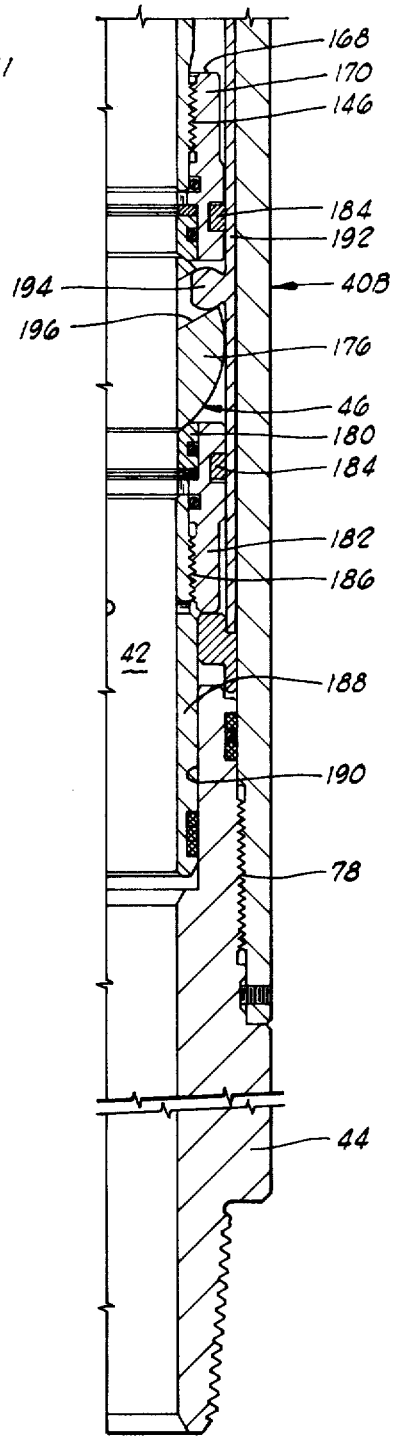

As previously mentioned, the upper end 242 of upper actuating mandrel 236 abuts the torquing lug 94 of valve housing 40B defining the uppermost position of upper actuating mandrel 236, and the biasing spring 244 provides an upward biasing force against the upper actuating mandrel 236 so that the upper actuating mandrel 236 is always located in the position illustrated in FIG. 4B relative to valve housing 40B.

Clockwise rotation as viewed from above of the upper actuating mandrel 236, as indicated by the arrow 262 in FIG. 8, is always transmitted to lower actuating mandrel 238 by the spherical ball member 252 which abuts a sharp straight side wall 264 of groove 260 as right-handed torque is transmitted from upper actuating mandrel 236 to lower actuating mandrel 238.

The other side wall of groove 260 opposite side wall 264 is not straight, but rather is divided into an upper portion 266 and a lower portion 268, both of which are sloped, with the upper portion 266 having a much larger angle to a radial line extending from the longitudinal center axis of the valve apparatus 36B than does the lower portion 268.

Thus, as counterclockwise torque, as is represented by the arrow 270 in FIG. 8, is transmitted from upper actuating mandrel 236 to lower actuating mandrel 238, when the torque becomes great enough the ball member 252 will be cammed radially outward into the radial bore 254 allowing the upper actuating mandrel 236 to freewheel relative to the lower actuating mandrel 238 thus governing the amount of counterclockwise torque which may be transmitted from upper actuating mandrel 236 to lower actuating mandrel 238.

The general manner of operation of the embodiment of FIGS. 4A–4D is substantially as follows.

When the valve apparatus 36B is initially made up with a packer means 34 and a slip joint 38 on the tubing string 32 and lowered into the well casing 20 as illustrated in FIG. 1, the connecting collar 56 is fully made up with threaded surface 92 of valve housing 40B and the threaded joint 234 between lower actuating mandrel 238 and valve housing 40B is fully made up as seen in FIG. 4C. The ball valve means 46 is in its open position as shown in FIG. 4D.

When the tubing string 32 is initially lowered into the well casing 20 to the point where it is desired to set the packer means 34, the valve apparatus 36B is in tension so that the stinger assembly 48B is positioned higher, relative to valve housing 40B, than shown in FIGS. 4A and 4B, so that the torquing lug 98 is engaging a bottom end of connecting collar 56. Thus the torquing lug 98 will be in engagement with torquing lug 94 of valve housing 40B so that clockwise rotation of the tubular string 32 will rotate the stinger assembly 48B and the valve housing 40B thus setting the packer means 34 against the well casing 20.

Then the weight of the upper portion of tubing string 32 is set down so that load transfer surface 62 of stinger assembly 48B touches down on support surface 66 of valve housing 40B, and the valve apparatus 36B is then in the position illustrated in FIGS. 4A–4D.

Then the upper portion of the tubing string 32 is again rotated clockwise as viewed from above through a first predetermined number of rotations relative to valve housing 40B.

Since the torquing lug 98 is received within the lug receiving groove 240 of upper actuating mandrel 236 and the upper and lower actuating mandrels 236 and 238 are connected by interlocking means 250, this rotates the lower actuating mandrel 238 clockwise as viewed from above through said first predetermined number of rotations relative to the valve housing 40B. This backs off the left-hand threaded connection 234 causing the lower actuating mandrel 238 to move longitudinally upward relative to valve housing 40B thereby moving the spherical ball valve means 46 to its closed position.

As the upper portion of the tubing string 32 is continued to be rotated clockwise as viewed from above through an additional predetermined number of rotations, the connection between threads 90 of connecting collar 56 and threaded surface 92 of valve housing 40B is completely undone so that the stinger assembly 48B is disconnected from the valve housing 40B and the upper portion of the tubing string 32 along with stinger assembly 48B may be removed from engagement with the valve housing 40B.

After the severe weather has passed and it is desired to reconnect the tubing string 32, the upper portion of tubing string 32 is lowered so that the stinger assembly 48B is lowered into engagement with the valve housing 40B. The lower end 162 of stinger mandrel 52B engages upward facing surface 164 of upper actuating mandrel 36, and the load transfer surface 62 of upper adapter 50 engages support surface 66 of valve housing 40B.

Then the upper portion of the tubing string 32 is rotated counterclockwise as viewed from above so as to once again make up the connecting collar 56 with the threaded surface 92, and so as to also once again make up the threaded connection 234 between lower actuating mandrel 238 and valve housing 40B.

As can be seen in FIGS. 4A and 4C, the threaded connection 234 contains fewer threads than does the threaded connection between threads 90 and 92, so that fewer counterclockwise rotations are required to fully make up the threaded connection 234 and thereby reopen ball valve means 46 than are required to fully make up the connecting collar 56 with threaded surface 92 of valve housing 40B.

The coil compression spring 244 provides a downward biasing force against lower actuating mandrel 238 which aids in initially making up the left-hand threaded portion of lower actuating mandrel 238 with the inner left-hand threaded surface of valve housing 40 at threaded connection 234.

When the threaded connection 234 is fully made up, the spherical ball member 252 will be adjacent the upper sloped side surface 266 of groove 260 so that when excessive torque is required to further tighten threaded connection 234, the upper actuating mandrel 236 is allowed to freewheel relative to lower actuating mandrel 238 thereby preventing damage to any of the components. Thus, the interlocking means 250 may be said to include a clutch means for allowing upper actuating mandrel 236 to rotate counterclockwise relative to lower actuating mandrel 238 after the threaded connection 234 is fully made up.

Thus, it is seen that the full opening emergency release and safety valve apparatus of the present invention, and the methods for use thereof, are readily adapted to achieve the ends and advantages mentioned as well as those inherent therein. While certain specific embodiments of the present invention have been illustrated for the purpose of this disclosure, numerous changes and modifications to the construction and arrangement of parts may be made by those skilled in the art which changes are encompassed within the spirit and scope of this invention as defined by the appended claims.

What is claimed is:

1. A releasable valve apparatus, comprising:

a valve housing having a flow passage therethrough and adapted to be connected to a tubing string;

a full opening ball valve means disposed in said valve housing for opening and closing said flow passage;

a stinger assembly adapted to be connected to said tubing string, said stinger assembly including a stinger mandrel releasably telescopingly received within said valve housing and operably associated with said ball valve means for opening and closing said ball valve means in response to manipulation of said upper portion of said tubing string; and releasable threaded connecting means for releasably interconnecting said valve housing and said stinger assembly; wherein said valve housing, ball valve means, stinger assembly and releasable threaded connecting means are so arranged and constructed that, when disconnecting said releasable threaded connecting means, a first predetermined number of rotations of said stinger assembly in a first rotational direction relative to said valve housing is necessary to allow said ball valve means to close said flow passage and an additional predetermined number of rotations of said stinger assembly in said first rotational direction relative to said valve housing is necessary to release said stinger assembly from said valve housing.

2. The apparatus of claim 1, further comprising:

means for governing a longitudinal force exerted on said releasable threaded connecting means when said stinger assembly is being reconnected to said valve housing.

3. The apparatus of claim 1, wherein:

said valve housing, ball valve means, stinger assembly and releasable threaded connecting means are so arranged and constructed that, after said stinger assembly has been rotated through said first predetermined number of rotations, said stinger assembly must be moved longitudinally upward relative to said valve housing to close said ball valve means.

4. The apparatus of claim 1, further comprising:

an actuating mandrel, disposed in said valve housing and having an upper end operably associated with said stinger mandrel and having a lower end connected to said ball valve means, said actuating mandrel being reciprocable with said valve housing between first and second positions corresponding to said open and closed positions of said ball valve means.

5. The apparatus of claim 4, further comprising:

valve spring means for biasing said actuating mandrel toward its said second position.

6. The apparatus of claim 5, further comprising:

latch means for latching said actuating mandrel in its said first position until said stinger assembly is rotated through said first predetermined number of rotations relative to said valve housing.

7. The apparatus of claim 6, wherein said latch means includes:

a plurality of collet fingers extending upward from said actuating mandrel about said stinger mandrel, each of said fingers having a head on an upper end thereof;

engagement means on said valve housing for engaging said heads and preventing upward movement thereof; and a latch holding surface on said stinger mandrel for engaging said heads and preventing said heads from moving out of engagement with said engagement means of said valve housing until said stinger assembly is rotated through said first predetermined number of rotations relative to said valve housing.

8. The apparatus of claim 7, wherein:

said latch holding surface of said stinger mandrel is an outer surface of a radially resilient spring collar disposed around said stinger mandrel, said spring collar being sufficiently resilient that when said actuating mandrel is in its said second position and said stinger mandrel is then reinserted into said valve housing, said collet finger heads may move radially inward against said spring collar and snap over said engagement means of said valve housing to allow said actuating mandrel to return to its said first position.

9. The apparatus of claim 8, wherein:

said radially resilient spring collar includes a cylindrical sleeve having a plurality of angularly spaced longitudinal slots therethrough, said slots terminating short of upper and lower ends of said sleeve thereby forming a plurality of longitudinally oriented parallel spring bars.

10. The apparatus of claim 8, wherein:

said valve mandrel includes a reduced diameter outer surface located below said spring collar so that when said stinger mandrel is moved upward relative to said valve housing said reduced diameter outer surface permits said collet finger heads to move radially inward out of engagement with said engagement means of said valve housing so that said valve spring means may move said actuating mandrel to its said second position thereby closing said ball valve means.

11. The apparatus of claim 7, wherein:

said latch holding surface is a cylindrical outer surface of said stinger mandrel;

said stinger mandrel further includes a reduced diameter cylindrical surface located below said latch holding surface, said reduced diameter surface and said latch holding surface being joined by a downward facing inwardly tapered transition surface; and said stinger mandrel, actuating mandrel, and valve housing are so arranged and constructed that when said actuating mandrel is in its said second position and said stinger mandrel is then reinserted into said valve housing, said transition surface of said stinger mandrel engages said collet finger heads from above and pushes said actuating mandrel downward until it reaches its said first position where said collet finger heads spring radially outward into engagement with said engagement means of said valve housing allowing said latch holding surface to move downward into engagement with said collet finger heads.

12. The apparatus of claim 4, wherein:

said releasable threaded connecting means includes a connecting collar disposed concentrically between said stinger mandrel and said valve housing, said connecting collar having a plurality of longitudinal inner splines on an inner surface thereof and having a threaded outer surface threaded in a second rotational direction opposite said first rotational direction;

said stinger mandrel includes a plurality of longitudinal outer splines meshed with said splines of said connecting collar and includes a retaining means located below said outer splines for limiting downward movement of said connecting collar relative to said stinger mandrel; and said valve housing includes a threaded inner surface for threaded engagement with said threaded outer surface of said connecting collar.

13. The apparatus of claim 12, wherein:

said stinger assembly, actuating mandrel, ball valve means, valve housing and connecting collar are so arranged and constructed that when said threaded outer surface of said connecting collar is fully made up with said threaded inner surface of said valve housing, movement of said ball valve means to its closed position is prevented, when said connecting collar is unthreaded from a fully made up position by said first predetermined number of rotations movement of said ball valve means to its said closed position is possible and said stinger assembly and valve housing are still connected, and when said connecting collar is fully unthreaded from said valve housing by said additional predetermined number of rotations said stinger assembly is released from said valve housing and may be withdrawn therefrom.

14. The apparatus of claim 13, further comprising:

governing means for governing a longitudinal force exerted downward on said connecting collar when said stinger assembly is being reconnected to said valve housing.

15. The apparatus of claim 14, wherein said governing means comprises:

a downward facing load transfer surface on said stinger assembly for engaging an upward facing support surface of said valve housing when said stinger assembly is fully inserted in said valve housing; and resilient compression spring means connected between said stinger assembly and an upper end of said connecting collar for applying a resilient downward force against said connecting collar to initially urge said threaded outer surface of said connecting collar into engagement with said threaded inner surface of said valve housing.

16. The apparatus of claim 1 in combination with said tubing string disposed in a well, said tubing string further comprising:

an upper tubing string portion connected to an upper end of said stinger assembly;

a lower tubing string portion connected to a lower end of said valve housing; and packer means, disposed in said lower tubing string portion, for sealing an annulus between said tubing string and said well and for supporting said lower tubing string portion within said well when said packer means is set to seal said annulus, said package means being constructed to be set by rotation of said upper tubing string portion, said stinger assembly and said valve housing in said first rotational direction.

17. The combination of claim 16, wherein:

said stinger mandrel further includes a radially outward extending torquing lug;

said valve housing includes a radially inward extending torquing lug; and said stinger assembly, valve housing, and releasable threaded connecting means are so arranged and constructed that when said connecting means is threadedly engaged with said valve housing said stinger assembly is longitudinally movable relative to said valve housing between an uppermost position wherein said outward and inward torquing lugs are engaged thereby permitting rotational motion to be transferred from said stinger assembly to said valve housing, and a lowermost position with said outward extending lug being below said inward extending lug so that said stinger assembly may be rotated relative to said valve housing.

18. The combination of claim 17, wherein:

said well is located on a bottom of a body of water;

said tubing string is suspended from a floating vessel on a surface of said body of water; and said upper tubing string portion has a slip joint means disposed therein for permitting movement of said floating vessel relative to said well due to waves and the like while maintaining a weight of said upper tubing string portion set down on said stinger assembly.

19. The apparatus of claim 1, wherein:

first and second portions of said valve housing are connected together by right hand threads;

each of said first and second portions of said valve housing has an outer left hand threaded surface; and said apparatus further includes a locking collar having internal left hand threads made up with said outer left hand threaded surfaces of said first and second portions of said valve housing, so that upon the transmission of left hand torque between said first and second portions of said valve housing said locking collar prevents relative rotation between said first and second portions of said valve housing.

20. A releasable valve apparatus, comprising:

a stinger assembly including an upper adapter means for connection to a tubing string and including a stinger mandrel extending down from said upper adapter, said stinger mandrel including a plurality of longitudinal external splines and an enlarged portion located below said splines and extending radially outward beyond said splines;

a cylindrical valve housing including a lower adapter means for connection to said tubing string;

a flow valve means disposed in said valve housing and movable between open and closed positions for opening and closing a flow passage through said valve housing;

an actuating mandrel, connected to said flow valve means, and operably associated with said stinger mandrel so that said actuating mandrel is movable within said housing between said first and second positions corresponding to said open and closed positions of said flow valve means; and a connecting collar disposed between said stinger mandrel and said valve housing and above said enlarged portion of said stinger mandrel, said collar including a plurality of longitudinal inner splines meshed with said outer splines of said stinger mandrel and including a threaded outer surface threadedly engaged with a threaded inner surface of said valve housing, so that said stinger mandrel and said valve housing are connected by said collar and said stinger mandrel is longitudinally movable within said valve housing when said threaded outer surface of said collar is threadedly engaged with said threaded inner surface of said valve housing, and so that said stinger mandrel may be disengaged from said valve housing when said collar is unthreaded from said valve housing.

21. The apparatus of claim 20, wherein:

said upper adapter means includes a downward extending annular skirt having an annular load transfer surface defined on a lower end thereof, said skirt being disposed concentrically around and radially outward from said stinger mandrel thereby defining an annular cavity between said skirt and said stinger mandrel; and said valve housing includes an upward facing annular support surface arranged to supportingly engage said load transfer surface of said upper adapter means when said stinger assembly is set down on said valve housing.

22. The apparatus of claim 21, further comprising:

resilient compression spring means disposed in an upper end of said annular cavity so that a longitudinal distance between said compression spring means and an uppermost thread of said threaded inner surface of said valve housing is less than a length of said connecting collar so that when said threaded outer surface of said connecting collar is initially made up with said threaded inner surface of said valve housing said compression spring means urges said compression collar downward against said valve housing.

23. The apparatus of claim 20, wherein:

said stinger mandrel further includes a radially outward extending torquing lug;

said valve housing includes a radially inward extending torquing lug; and said stinger assembly, valve housing, and connecting collar are so arranged and constructed that when said connecting collar is threadedly engaged with said valve housing, said stinger assembly is longitudinally movable relative to said valve housing between an uppermost position wherein said outward and inward extending torquing lugs are engaged thereby permitting rotational motion to be transferred from said stinger assembly to said valve housing, and a lowermost position with said outward extending lug being below said inward extending lug so that said stinger assembly may be rotated relative to said valve housing.

24. The apparatus of claim 20, wherein:

said actuating mandrel includes a plurality of upward extending spring collet fingers each having a radially outward extending head on an upper end thereof;

said valve housing includes a radially inward extending ledge arranged so that said first position of said actuating mandrel is defined by engagement of an upward facing surface of each of said heads of said spring collet fingers with a downward facing surface of said ledge; and said stinger mandrel includes a first radially outer surface having a diameter such that when said first surface is engaged with said spring collet fingers said heads are prevented from moving radially inward out of engagement with said downward facing surface of said ledge, and said stinger mandrel further includes a second reduced diameter outer surface located below said first surface so that when said stinger mandrel is moved upward and said reduced diameter surface is adjacent said heads said collet fingers may move radially inward out of engagement with said downward facing surface of said ledge.

25. The apparatus of claim 24, wherein:

said first outer surface of said stinger mandrel is an outer surface of a radially resilient spring collar disposed around said stinger mandrel, said spring collar being sufficiently resilient that when said actuating mandrel is in its said second position and said stinger mandrel is then reinserted into said valve housing, said collet finger heads may move radially inward against said spring collar and snap over and downward past said ledge of said valve housing to allow said actuating mandrel to move to its said first position.

26. The apparatus of claim 25, wherein:

said radially resilient spring collar includes a cylindrical sleeve having a plurality of angularly spaced longitudinal slots therethrough, said slots terminating short of upper and lower ends of said sleeve thereby forming a plurality of longitudinally oriented parallel spring bars.

27. The apparatus of claim 20, wherein:

said actuating mandrel includes a plurality of upward extending spring collet fingers each having a radially outward extending head on an upper end thereof;

said valve housing includes an annular groove in a radially inner surface thereof for receiving said heads of said spring collet fingers when said actuating mandrel is in its said first position; and said stinger mandrel has a first radially outer surface having a diameter such that when said first surface is engaged with said spring collet fingers said heads are prevented from moving radially inward out of said groove, and said stinger mandrel further includes a second reduced diameter outer surface located below said first surface so that when said stinger mandrel is moved upward and said reduced diameter surface is adjacent said heads said collet fingers may move inward out of said groove.

28. The apparatus of claim 20 in combination with said tubing string disposed in an oil well, said tubing string further comprising:

an upper tubing string portion connected to said upper adapter of said stinger assembly;

a lower tubing string portion connected to said lower adapter of said valve housing; and packer means disposed in said lower tubing string portion, for sealing an annulus between said tubing string and said well and for supporting said lower tubing string portion within said well when said packer means is set to seal said annulus, said packer means being constructed to be set by rotation of said upper tubing string portion, said stinger assembly and said valve housing.

29. The combination of claim 28, wherein:

said stinger mandrel further includes a radially outward extending torquing lug;

said valve housing includes a radially inward extending torquing lug; and said stinger assembly, valve housing, and connecting collar are so arranged and constructed that when said connecting collar is threadedly engaged with said valve housing said stinger assembly is longitudinally movable relative to said valve housing between an uppermost position wherein said outward and inward torquing lugs are engaged thereby permitting rotational motion to be transferred from said stinger assembly to said valve housing, and a lowermost position with said outward extending lug being below said inward extending lug so that said stinger assembly may be rotated relative to said valve housing.

30. The combination of claim 29, wherein:

said well is located on a bottom of a body of water;

said tubing string is suspended from a floating vessel on a surface of said body of water; and said upper tubing string portion has a slip joint means disposed therein for permitting movement of said floating vessel relative to said well due to waves and the like while maintaining a weight of said upper tubing string portion set down on said stinger assembly.

31. A method of closing off and disconnecting from a tubing string disposed in a well located on a bottom of a body of water, comprising:

attaching a packer means, a releasable valve apparatus, and a slip joint to said tubing string;

lowering said packer means into said well;

setting said packer means within said well by rotating said tubing string in a first direction with said valve apparatus in tension;

setting down an upper portion of said tubing string so that said valve apparatus is in compression and so that a lower portion of said tubing string below said packer means is supported within said well by said packer means;

while said valve apparatus is in compression, rotating said upper portion of said tubing string again in said first direction a first predetermined number of rotations to permit a flow valve of said releasable valve apparatus to be closed; then while said valve apparatus is still in compression, continuing to rotate said upper portion of said tubing string in said first direction an additional predetermined number of rotations to release an upper portion of said releasable valve apparatus from a lower portion of said releasable valve apparatus; and lifting said upper portion of said tubing string and pulling said upper portion of said releasable valve apparatus out of engagement with said lower portion of said releasable valve apparatus thereby disconnecting said upper and lower portions of said tubing string so that said lower portion of said tubing string remains in said well.

32. The method of claim 31, said method being further characterized as a method of closing off and disconnecting from said tubing string of said well and subsequently reconnecting and opening said tubing string, said method further comprising:

lowering said upper portion of said tubing string and thereby re-engaging said upper portion of said releasable valve apparatus with said lower portion of said releasable valve apparatus;

setting down said upper portion of said tubing string and thereby opening said flow valve in said lower portion of said releasable valve apparatus and placing said releasable valve apparatus in compression; and while said releasable valve apparatus is in compression, rotating said upper portion of said tubing string in a second direction opposite said first direction and thereby reconnecting said upper and lower portions of said releasable valve apparatus so that said upper and lower portions of said tubing string are once again connected and said flow valve is maintained in its open position.

33. The method of claim 32, further comprising:

governing a longitudinal compressive loading on a threaded connection between said upper and lower portions of said releasable valve apparatus when said threaded connection is made up by said rotation of said upper portion of said tubing string in said second direction.

* * * * *